US005490879A

United States Patent [19]

Corradi et al.

[11] Patent Number: 5,490,879

[45] Date of Patent: Feb. 13, 1996

[54] DEVICE FOR COATING AND/OR IMPREGNATING A CONTINUOUSLY MOVING BAND OF MATERIAL WITH A LIQUID OR PASTY PRODUCT

[75] Inventors: Gabriel Corradi; Thierry Pellegrino, both of Soissons, France

[73] Assignee: Societe Anonyme: M. Chemicals, Saint Germain, France

[21] Appl. No.: 121,343

[22] Filed: Sep. 14, 1993

[30] Foreign Application Priority Data

Dec. 17, 1992 [FR] France ..... 92 15665
Jun. 29, 1993 [EP] European Pat. Off. ..... 93490013

[51] Int. Cl.[6] ..... B05C 1/00

[52] U.S. Cl. ..... 118/212; 118/410; 118/413; 118/216; 118/255; 427/256; 427/278

[58] Field of Search ..... 118/202, 211, 118/212, 213, 216, 255, 264, 266, 271, 410, 413, 414, 419, 427, 123, 100, 679, 669, 672; 427/256, 428, 277, 278, 355; 401/281, 197, 13

[56] References Cited

U.S. PATENT DOCUMENTS

| | | | |
|---|---|---|---|
| 2,659,340 | 11/1953 | Zinn, Jr. | 118/202 |
| 2,851,003 | 9/1958 | Binsted et al. | 118/18 |
| 3,587,526 | 6/1971 | Geschwender | 118/211 |
| 3,645,666 | 2/1972 | Bailey | 427/277 |
| 3,776,185 | 12/1973 | Kawasaki | 118/406 |
| 4,550,681 | 11/1985 | Zimmer | 118/406 |

*Primary Examiner*—Brenda A. Lamb
*Attorney, Agent, or Firm*—Harrison & Egbert

[57] ABSTRACT

A device (1) for coating and/or impregnating a band (2) in continuous movement (3) with a liquid or pasty product, including an applicator (4) for depositing a layer (5) of the product, at least partially on one face (6) of the band. The device includes applicators (4) which are constituted by a reservoir (7, 70, 407) having a perforated area (8, 21,), brought into contact with the face (6) to be coated and/or impregnated, around which the band is deflected, having on a portion of its shell a set of orifices (9, 90, 409) opening externally and communicating internally with a product feed chamber (10, 110, 410), the surface and/or permeability of which are adjustable.

6 Claims, 9 Drawing Sheets

DEVICE FOR COATING AND/OR IMPREGNATING A CONTINUOUSLY MOVING BAND OF MATERIAL WITH A LIQUID OR PASTY PRODUCT

TECHNICAL FIELD

The invention relates to a device for coating and/or impregnating a continuously moving band of material with a liquid or pasty product.

It will find a use, in particular, in numerous technical fields using as a raw material bands of flexible material, such as paper, cardboard, textiles, or again, plastic, that are caused to travel past at a greater or lesser speed, and wherein it is necessary to process one face of the band as it travels past in order to deposit thereupon a layer of liquid or pasty product, such as, for example, ink, glue, paint, or, more generally, any technical product, for decoration or treatment.

Furthermore, the invention will find an application in equipping such machines producing continuously moving bands of material.

BACKGROUND ART

By way of example, in the field of corrugated cardboard manufacture, it is customary to attach the strips of paper with glue. More precisely, a film of glue is deposited uniformly, in a given quantity, on one of the faces of these strips, and then the two strips are pressed and dried to form the band of cardboard.

In this connection, there are known .devices, such as wetting rolls, constituted by a cylinder immersed in a bath of the product to be applied. The main drawbacks of such devices reside in the difficulty of adjusting the quantity of product to be deposited, and in the fact that it is impossible to carry out partial treatments over a width less than that of the cylinder.

We also know spraying devices which enable the flow rate to be regulated via spray jets. However, in these devices, it is difficult to regulate the uniformity of the deposit provided. In addition, the use of pasty products is entirely out of the question.

Also known is a device for applying a liquid or pasty product on a continuously moving band, comprising means for depositing a film of liquid or pasty product on a surface of the band to be processed, as well as product feed means.

More precisely, the device comprises a product reservoir constituted by a sheet of flexible plastic, pressed over the moving band by means of a pressing blade, disposed across the band and forming the lower part of the reservoir.

To allow the product to be deposited on the moving band, the said plastic sheet has a rectangular window, the dimensions of which define the coating width and the quantity of product deposited.

Although this device gives satisfaction in certain cases, it is, however, unsuitable for high production rates, and its reliability depends on the tension applied to the band and on the quality of application of the window to the band.

As regards the coating of a band when only a portion of the width is coated, it receives a certain amount of humidity with the coating product, in particular in the form of an aqueous emulsion, it being necessary to moisten the non-processed portion with a thin film of water so that the moisture content of the band is fairly regular and homogeneous, to avoid, in particular, any phenomena of deformation liable to impair its flatness.

Now, given the high production rates of the devices used, which can, for example, represent as much as 300 m per minute of product coated over a width of 2 m 50, it is difficult to achieve swift adjustment of the manufacturing sequences, particularly when it is necessary to change coating products and/or modify the width of the band or bands to be coated. Now, in practice, such time consuming operations are prejudicial to the satisfactory operation of the device as several meters of cardboard thus travel past uncoated and have to be discarded, which leads to the production of waste through losses of material and increases manufacturing costs.

The object of the present invention is to provide a device for coating and/or impregnating with a liquid or pasty product a continuously moving band of material, which makes it possible to remedy the aforementioned drawbacks and which does not act as a curb on high production rates.

One of the objects of the present invention is to provide a coating and/or impregnating device that can be inserted into lines of machines for producing continuously moving bands of material and which is robustly and reliably constructed to enable it to operate at very high speeds of travel.

One of the objects of the present invention is to provide a device for coating and/or impregnating with a liquid or pasty product which makes it possible to control with accuracy the depositing of the said produce on the band of material travelling past, as well as its geometry, without it being necessary to modify the structure of the elements used.

Another object of the present invention is to provide a device for coating and/or impregnating with a liquid or pasty product which, thanks to its structure, permits easy control of its operation as well as automation of its settings.

Another object of the present is to provide a coating and/or impregnating device that does not slow down the manufacturing rates if, by reason of its adjustment, it is no longer in working position.

Another object of the present invention is to provide a coating and/or impregnating device that enables different products to be applied or deposited simultaneously or otherwise, thus increasing its working capabilities.

Another object of the present invention is to provide a coating and/or impregnating device that enables the cleaning fluids to be circulated and recovered in order to prevent pollution.

A further object of the present invention is to provide a coating and/or impregnating device which allows a better moisture content to be obtained over the whole of the band to be coated and/or impregnated while, at the same time, avoiding waste-generating losses of material.

Further objects and advantages of the present invention will become apparent in the course of the following description which is given, however, only by way of example, and is not intended to limit same.

SUMMARY OF THE INVENTION

According to the present invention, the device for coating and/or impregnating a continuously moving band with a liquid or pasty product, comprising application means for depositing a layer of the said product, at least partially on one face of the said band, is characterized by the fact that the application means are constituted by a reservoir having a perforated area, brought into contact with the face to be coated and/or impregnated, around which the said band is deflected, comprising on a portion of its shell a set of orifices opening externally and communicating internally with a product feed chamber, the surface area and/or permeability of which are adjustable.

BRIEF DESCRIPTION OF THE DRAWINGS

The invention will be more clearly understood with reference to the following description, as well as to the annexed drawings which form an integral part thereof.

DETAILED DESCRIPTION OF THE INVENTION

The invention relates to a device for coating and/or impregnating a continuously moving band of material with a liquid or pasty product.

While more especially developed in the context of equipping machines for the manufacture of corrugated cardboard, the present invention is in no way limited to such an application and it will, in a general manner, find an application in any type of field using as a raw material bands of flexible material such as paper, cardboard, fabric or plastic, which are caused to travel past at high speed, and wherein it is necessary to process a face of the band while it travels past, in order to deposit thereupon a film of liquid or pasty product, such as, for example, ink, glue, an impregnating agent, or any other product for decoration or for treatment.

As regards the coating products, during the coating operation, they are protected from the air until the moment when they are deposited on the material and, as a result, they are enclosed and protected from dust and from drying in such a way as to prevent any release of gas, to the benefit of the environment and of human beings, as such gases can, in particular, be dangerous, explosive or inflammable at low temperatures.

Figure 1:
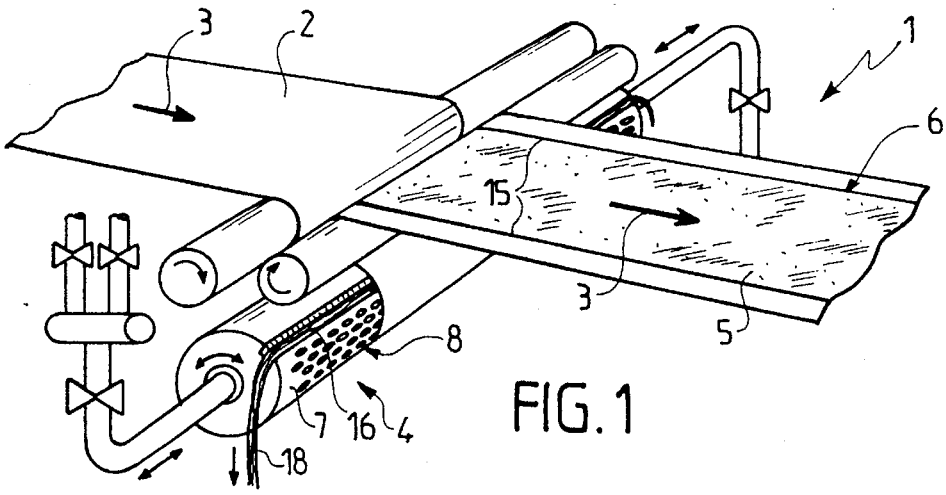
FIG. 1 schematically represents a perspective view of a first form of embodiment of the coating and/or impregnating device of the present invention.

FIG. 1 schematically represents, in perspective, a first form of embodiment, of device 1 of the present invention, wherein 2 represents a continuously moving band of material, simulated by arrows 3.

The device comprises application means 4 for depositing a layer 5 of liquid or pasty product at least partially on a face 6 of the band, as shown in FIG. 1.

More precisely, these application means 4 are constituted by a reservoir 7 having a perforated area 8, placed in contact with the face 6 to be coated and/or impregnated, the surface area and/or permeability of which are adjustable.

Figure 2:
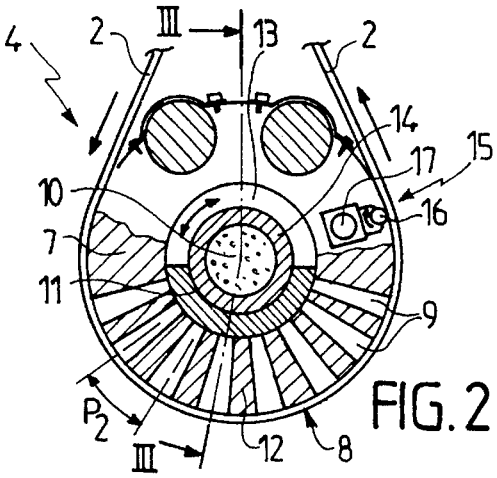
FIG. 2 is a cross-sectional view of the application means represented in FIG. 1 in a blocked position.
Figure 3:
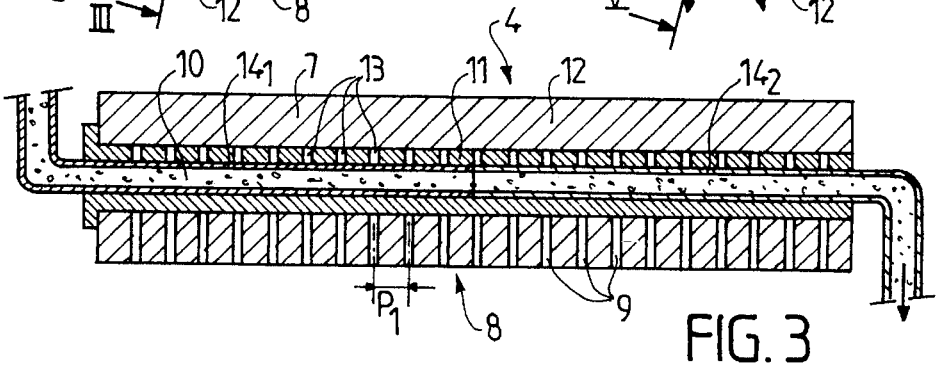
FIG. 3 is a longitudinal cross-section of the application means represented in FIG. 2 along line III—III.

If we refer to FIGS. 2 and 3, we can see the design structure of this reservoir 7. In this case, reservoir 7 takes the form of a cylinder, fixed in relation to the movement of travel 3 of band 2, around which the said band 2 is deflected, as shown in particular in FIG. 1.

Furthermore, cylinder 7 has, on one portion of its shell 8, a set of orifices 9 opening externally and communicating internally with a product feed chamber 10.

In addition, reservoir 7 has, in its internal portion, a radial blocking tube 11, adapted to control the radial permeability of the set of orifices 9 and, consequently, the thickness of the layer 5 deposited.

More precisely, in the form of embodiment illustrated, the reservoir 7 is constituted by a set of coaxial tubes fitted to one another. A first, external tube 12 is pierced by a plurality of radial orifices 9, regularly spaced apart at a pitch "$P_1$" in the longitidunal direction, and at a pitch "$P_2$" in the radial direction.

By way of example, when developing the shell of cylinder 12, having a diameter of 200 for example, good results have been obtained by providing orifices with a diameter of 25 mm, alternately staggered, with a pitch $P_1$ of 20 mm and an pitch $P_2$ of 26 mm. These orifices can be cylindrical or of a flared shape to increase the surface of the orifice in contact with the band, as shown in the figures.

It was also noted that it was sufficient to provide this set of orifices 9 over half the periphery of the cylinder, and, for example, given the dimensions aforementioned, rows of five orifices are alternated with rows of four orifices. However, this information is given by way of example, and it would be perfectly possible to contemplate using other dimensional and positional characteristics.

In addition, inside this first tube 12 is fitted a second tube, 11, which is pierced, for its part, with a plurality of annular, mutually parallel passages 13, spaced apart at the pitch of "$P_1$".

Under these conditions, these passages are placed opposite the corresponding rows of orifices 9 and, thanks to the fact that the second tube 11 is mounted so as to be free to rotate in relation to first tube 12, orifices 9 in each row can be covered to a varying extent.

Figure 4:
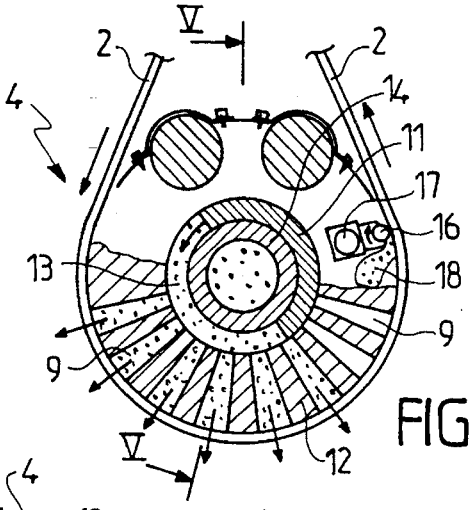
FIG. 4 is a cross-sectional view of the same application means as illustrated in FIG. 2, but in a working position permitting coating and/or impregnation.
Figure 5:
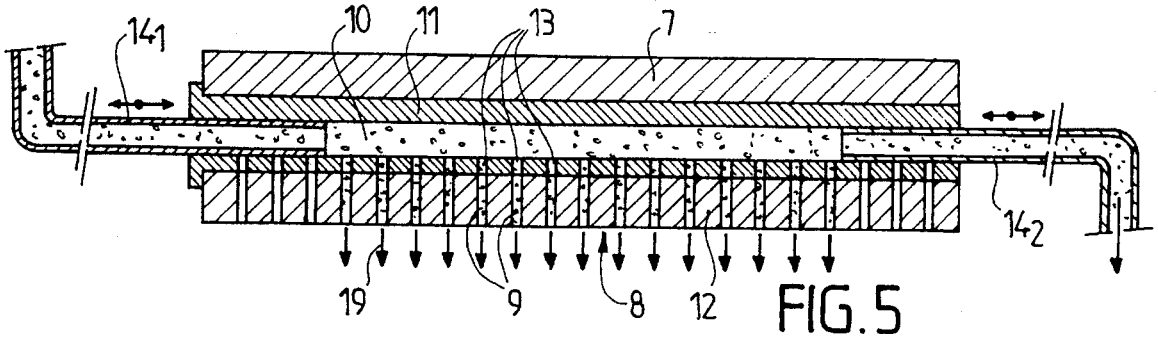
FIG. 5 is a longitudinal cross-sectional view of the application means represented, in a working position in FIG. 4 along line V—V.

By choosing the half-diameter arrangement illustrated, it is then possible, by rotating tube 12, either to cover holes 9 completely, as shown in FIGS. 2 and 3, or to allow them to communicate with feed chamber 10 from 0 to 100%, as shown, in particular in FIGS. 4 and 5.

This arrangement will make it possible to adjust the radial permeability of perforated area 8 brought into contact with the face to be coated and/or impregnated, and, in consequence, to control the thickness of the layer deposited.

This being the case, to be able to control the transverse permeability of the set of orifices 9, and thus the width of layer 5 that has been deposited, as shown in particular in FIGS. 1 to 5, reservoir 7 has, in its internal portion, at least one transverse blocking tube 14.

This third tube 14, which is fitted into the second tube 11, defines an internal conduit constituting the said product feed chamber 10. Furthermore, this third tube is mounted in such a way that it can be displaced in longitudinal translation in relation to second tube 11.

Furthermore, as shown in FIGS. 3 and 5, in order to be able to adjust the width, and to act independently on the right and left borders 15 of the layer deposited, transverse blocking tube 14 will advantageously be formed by two half-tubes, $\mathbf{14_1}$ and $\mathbf{14_2}$, transversely mobile in second tube 11, so that it is possible to close all the passages 13, as shown in FIG. 3, or certain of the passages, as shown in FIG. 5, or to allow unimpeded passage through all the orifices.

This being the case, in order to level out the deposit of the said product on the band, the device according to the present invention further comprises, placed downstream of the application means 4, means for scraping the coated band.

In an advantageous form of embodiment, and as shown particularly in FIGS. 2 to 16, these means are constituted by so-called "Meyer" bar 16, known to the plan of the art.

This bar is, for example, constituted by a wire wound in a spiral and welded that it causes to turn in the direction opposite that of the feed of the band, as illustrated in the figure. This bar is further pressed onto the band, via an air chamber 17, for example.

Thus, by suitably adjusting the scraping means 15, the excess 18 is discharged laterally to the outside of the band to be processed.

It should be noted that the device according to the present invention is also equipped with different pipes and stop cocks, so that it is possible to inject into tube $\mathbf{14_1}$ or $\mathbf{14_2}$, or both, for example the product to be deposited on the band, which is then channelled by the internal conduit of the second tube 11, and then discharged through passages 13 and orifices 9 to the band, as simulated by arrows 19 in FIG. 5.

Figure 6:
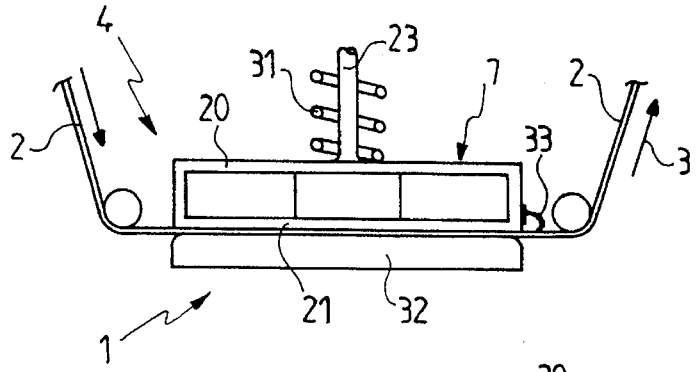
FIG. 6 schematically represents a second form of embodiment of the coating and/or impregnating device of the present invention.
Figure 7:
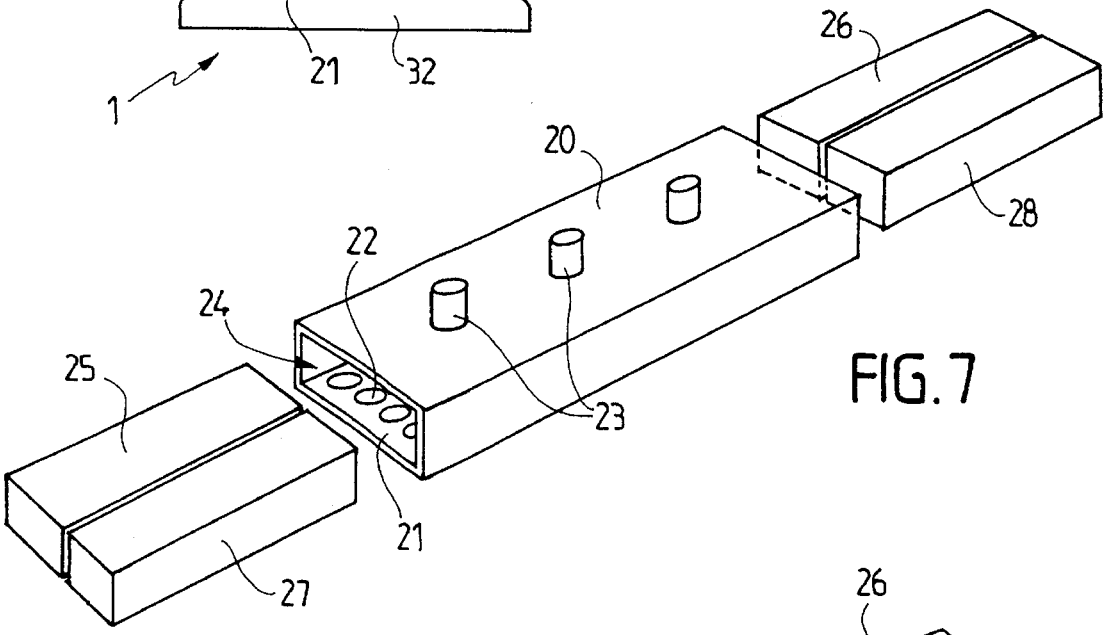
FIG. 7 represents an exploded view of the application means in a first variant.
Figure 8:
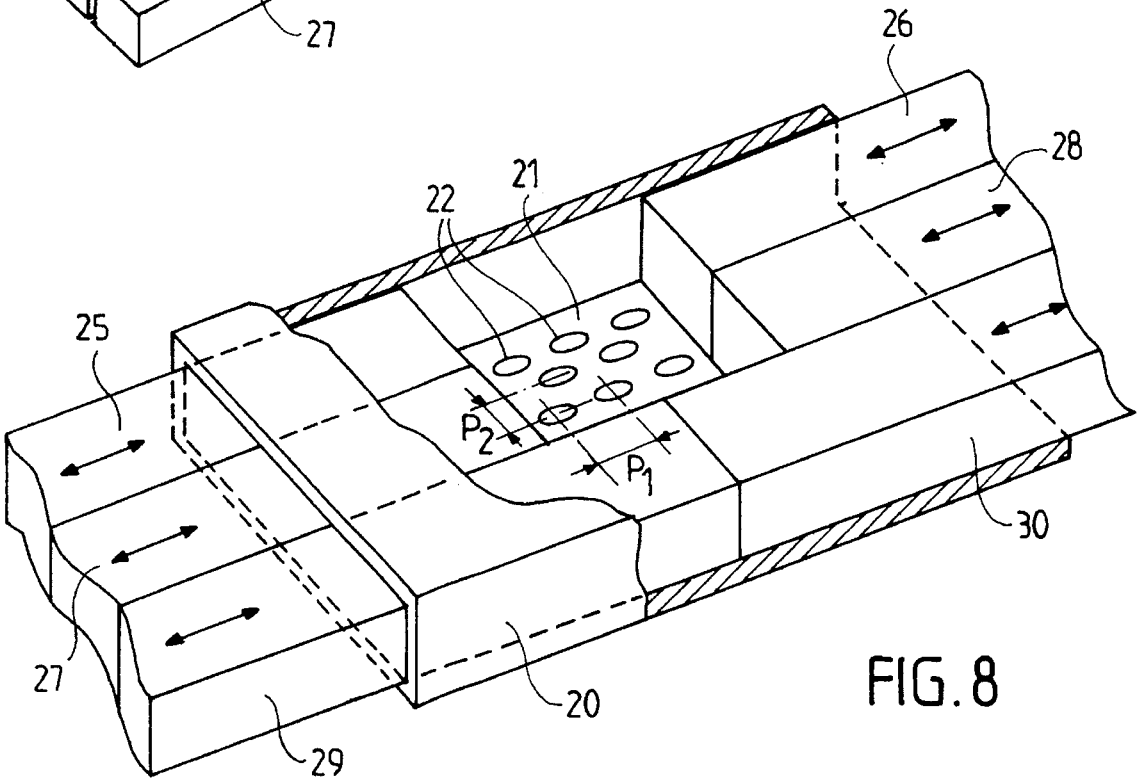
FIG. 8 is a perspective view in partial cross section of the application means of FIG. 6.

FIGS. 6 to 8 show a second form of embodiment of the device according to the present invention, in which reservoir 7 takes the form of a polyhedron 20, one of the faces, 21, of which is placed in contact with band 2 as it travels 3, and it has a set of orifices 22 opening externally and communicating internally with a product feed chamber.

In this case, as shown in particular in FIG. 7, product feed takes place via orifices 23 distributed over the upper surface and opening in the internal cavity 24 of the said polyhedron.

In the form of embodiment represented in the figures, the polyhedron takes the form of a tube 20 with a rectangular cross-section, inside which are slidingly provided one or more closing devices 25 to 30.

These closing devices 25 to 30 are adapted to slide longitudinally in the internal chamber 24 of tube 20 to control longitudinal permeability and, consequently, the thickness of the layer deposited and/or the transverse permeability, and thus the width of the layer deposited.

Indeed, as in the preceding form of embodiment, through the action of closing devices 25 to 30, it is possible, on one hand, to select an area of holes 22 in the direction of pitch "$P_2$" and, on the other hand, to adjust the width to be coated in the direction of pitch "$P_1$", as shown, in particular, in FIG. 8.

Furthermore, the perforated area 21 in reservoir 20 is applied to the moving band with a counter-pressure, simulated in FIG. 6 by the presence of spring 31 and lower anvil member 32. Nonetheless, other counter-pressure means could be contemplated.

In addition, in a manner similar to that of the first form of embodiment, the device can be equipped, downstream of the application means, with scraping means, here numbered 33, and constituted, for example, by a flexible blade rubbing against the band at the output from the applicator reservoir 7, as represented in FIG. 6.

Nonetheless, a "Meyer" bar, with a counter-pressure on the other side of the band, could also be provided.

Figure 9:
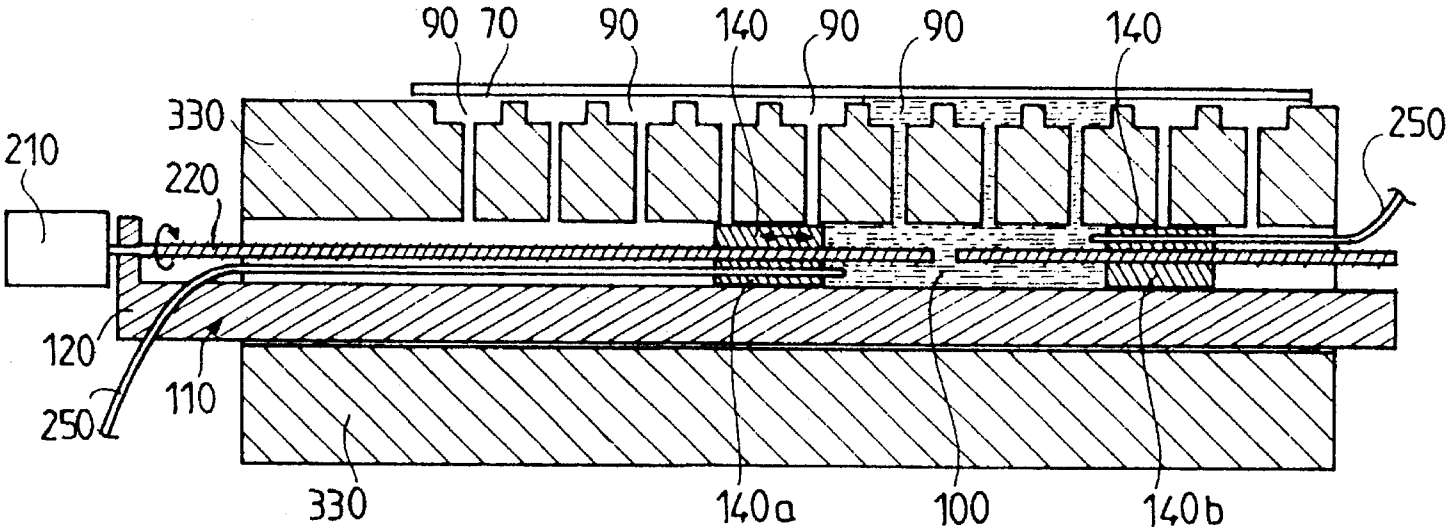
FIG. 9 is a longitudinal cross-sectional view of the application means illustrated in FIG. 1.
Figure 10:
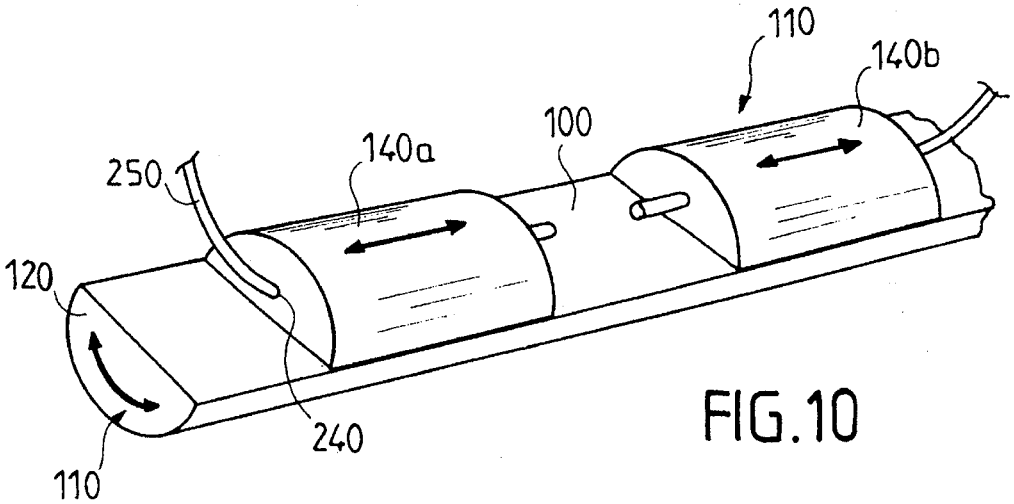
FIG. 10 is a schematic view, in perspective, illustrating a form of embodiment of a feed chamber equipping a device according to the invention.

With more particular reference to FIGS. 9 and 10, it can be seen that the radial blocking means 110 are constituted by a body of a feed core 120, a part of whose surface is formed by at least a part of an arc, and by two feed delimiters **140*a*, 140*b* mounted so as to be mobile in translation over the said body 120 and through which pass feed conduits with a view to ensuring distribution of the product to the feed chamber 100**.

Figure 12:
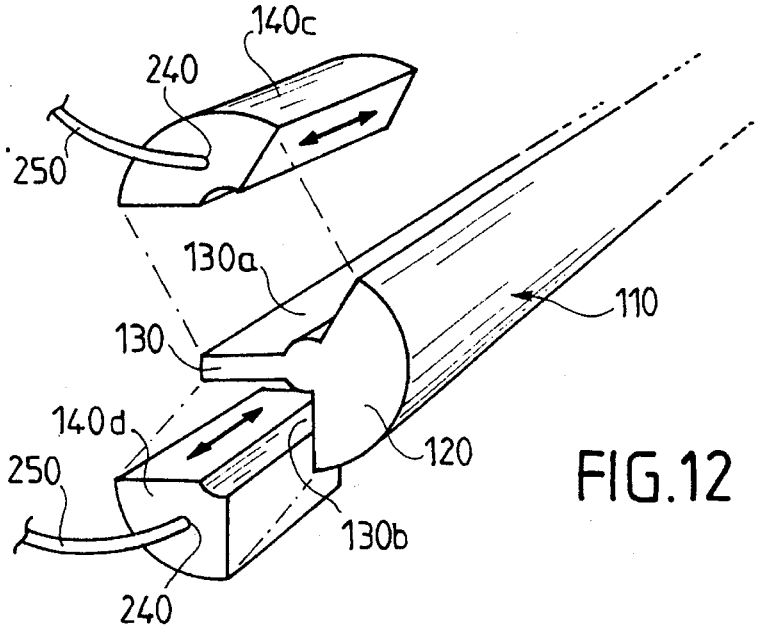
FIG. 12 is a schematic view illustrating another variant of the body of a feed core, on which is movably and slidably mounted at least one feed delimiter, and at least one part of the surface whereof is constituted by at least a portion of the arc of a circle, and which has two application chambers.

In another form of embodiment, such as the one shown more particularly in FIG. 12, the body 120 of the feed core comprises an arm 130, projecting perpendicularly, defining on either side of itself two feed chambers **130*a*, 130*b*, designed to receive a feed delimiter 140*c*, 140*d*, constituting transverse blocking means in order to control the transverse permeability of the set of orifices 9** and, consequently, the width of the layer deposited.

Figure 13:
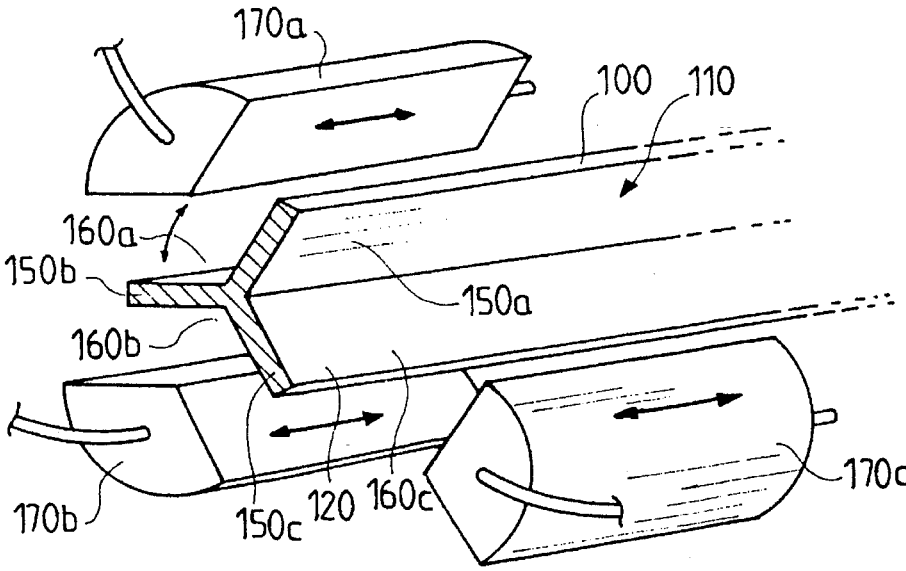
FIG. 13 is schematic view illustrating another variant of the body of a feedcore, on which is movably and slidably mounted at least one feed delimiter, and which is provided, here, with three arms, the free ends of which are disposed at the apex of a virtual triangle, and which comprises three application chambers.

In another form of embodiment, such as the one that is more particularly illustrated in FIG. 13, body 120 of the feed core comprises three arms, **150*a*, 150*b* and 150*c*, the free end of each of which is placed at the apex of a virtual triangle circumscribed by a virtual circle concentric to the axis of body 120, and which delimits respectively feed chambers 160***a*, 160*b*, 160*c*, designed to receive each at least one feed delimiter 170*a*, 170*b*, 170*c*, of a matching shape through which pass feed pipes 250 so as to ensure distribution of the product to the said feed chambers 160*a*, 160*b* and 160*c*. Thus, in practice, two feed delimiters are necessary to coat a band, and at least three if it is wished to coat at least two strips.

Figure 14:
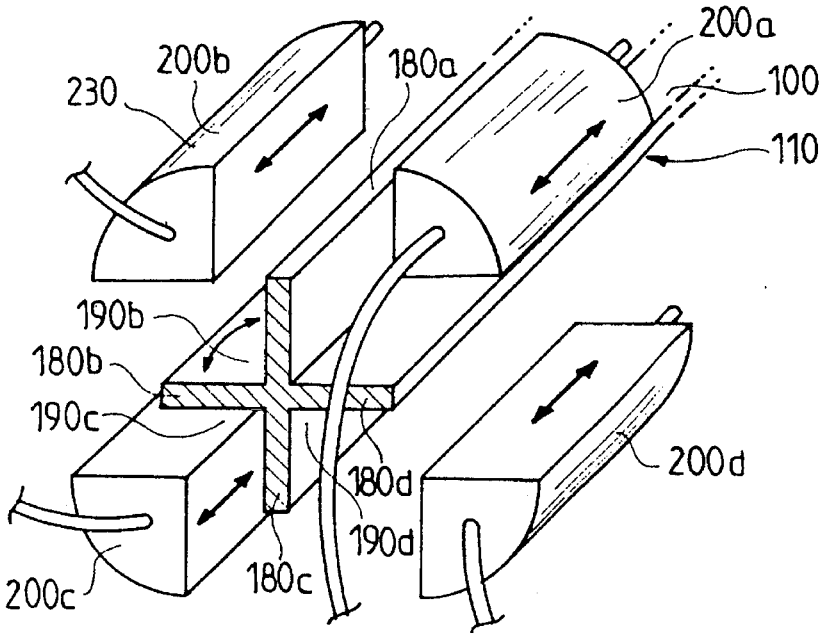
FIG. 14 is a schematic view illustrating another variant of the body of a feed means, on which is slidingly mounted at least one feed delimiter, and which has four branches, the free ends of which are placed at the apex of a virtual square, and which comprises four application chambers.

It is also possible, in another form of embodiment, such as the one represented more particularly in FIG. 14, to produce a body 120 of the feed core that has four arms, 180*a*, 180*b*, 180*c* and 180*d*, the free end of each of which is placed at the apex of a virtual square circumscribed by a virtual circle concentric with the axis of body 120, and which respectively delimits feed chambers 190*a*, 190*b*, 190*c* and 190*d*, designed each to receive at least one feed delimiter 200*a*, 200*b*, 200*c* and 200*d* of a matching shape, through which pass feed pipes 25 designed to permit product to be distributed to the said feed chambers 190*a* to 190*d*.

It should also be noted that, in the form of embodiment illustrated in FIG. 9, the reservoir 70 has an area 80 perforated by a plurality of radial orifices 90, regularly spaced at a pitch "$P_1$" in the longitudinal direction, and at a pitch "$P_2$" in the radial direction.

In addition, reservoir 70 is constituted by an external first tube 330, pierced by a plurality of radial orifices 90, regularly spaced, by blocking means 110 adjustable in the first tube 330, and suitable for being displaced, in rotation, by motor means not represented, and by feed delimiters 140*a*, 140*b*, 170*a*, 170*c*, 200*a*, 200*d* fitted inside body 120 of the feeder core defining at least: an inner cavity constituting the said product feed chamber, and which are adapted to be displaced in longitudinal translation in relation to the said body 120, via motor means 210 which actuate a worm screw 220 with a view to delimiting the width of the material to be processed. As to the motor means, these can be, for example, constituted by linear jacks, or any other device equipped with suitable adjusting means.

Furthermore, feed delimiters 140*a*, 140*b*, 140*e*, 140*f*, 170*a*, 170*c* and 200*a*, 200*d* have a body 230 the shape of which matches that of the application chamber in which they are adapted to be displaced in longitudinal translation over body 120. Thus, by way of example, this body can have a surface formed by at least a portion of a semi-circle, as more particularly illustrated in FIGS. 10 and 11, or a quarter of a circle, as shown in FIGS. 12 to 15.

This body 230 comprises an axial orifice 240 designed to permit the passage of a conduit 250 for feeding product to be deposited on the band, as well as for discharging the excess product.

Under these conditions, given that the feed delimiters 140*a*, 140*b*, 170*a*, 170*c* and 200*c*, 200*d* are adapted to be moved in longitudinal translation in relation to the body 120, the orifices 90 of each row will be covered to a varying extent, and the width of the layer deposited will thus be adjusted.

Thus, according to requirements, one can contemplate causing orifices 90 to be blocked to a greater or lesser degree so as to allow them to communicate with feed chamber 100 according to a configuration permitting their use from 0 to 100%.

This arrangement will make it possible to adjust the radial permeability of the perforated area 80, brought into contact with the face to be coated and/or impregnated and, in consequence, to control the thickness of the layer deposited.

Figure 11:
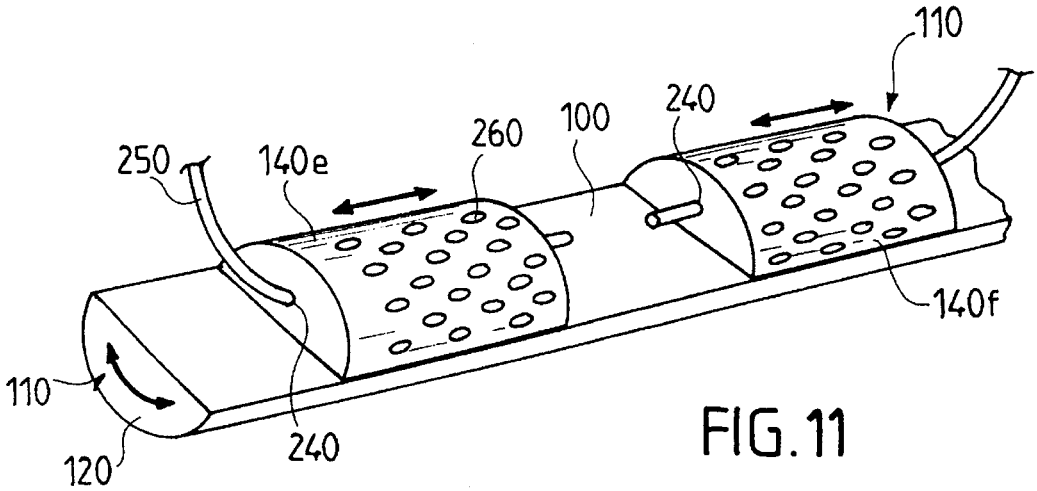
FIG. 11 is a schematic view, in perspective, illustrating a variant of a feed chamber equipping a device according to the invention.

In a form of embodiment such as the one more particularly illustrated in FIG. 11, the body 230 of the application delimiter 140*e*, 140*f* has a regular distribution of radial orifices 260, designed to permit, according to their position in relation to orifices 90, the placing of the impregnating product on the face of the band. Furthermore, according to the invention, as shown in FIGS. 12 to 15, by using several application delimiters 140*a*, 140*d*, 140*e*, 140*f*, 170*a*, 170*c*, 200*a*, 200*d*, it is possible to apply different products separately to the face of the band, and thus increase the utilisation capabilities of the device according to the invention.

It should also be noted that, thanks to the use of several application delimiters, it is also possible to provide for rinsing the products applied, which facilitates the use of the device by avoiding, in particular, the risks of pollution.

Furthermore, to level out the deposit of the said product on the band, there are also provided, placed downstream of the application means, adjusting means which can, for example, take the form of a "Meyer" bar, as well as devices having various pipes and/or stop cocks so as to permit injection of the product to be deposited on the band, as well as to adjust or control the circulation of the different fluids, such as, for example, the cleaning fluid.

Figure 15:
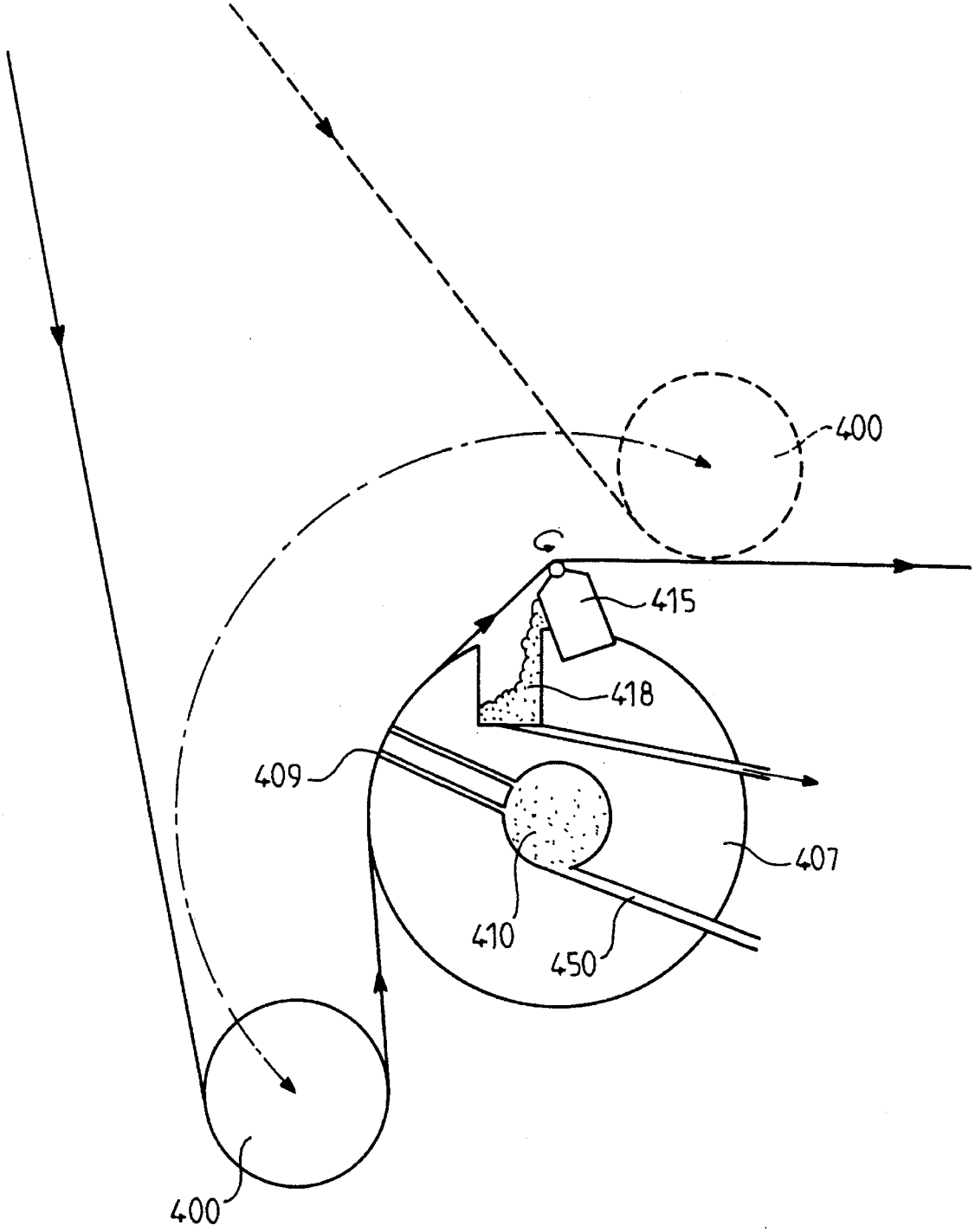
FIG. 15 is a schematic cross-sectional view illustrating a coating and/or impregnating device equipped with a Meyer bar to ensure that a layer of product with which a moving band of product is to be coated and/or impregnated is regularly and homogeneously applied.
Figure 16:
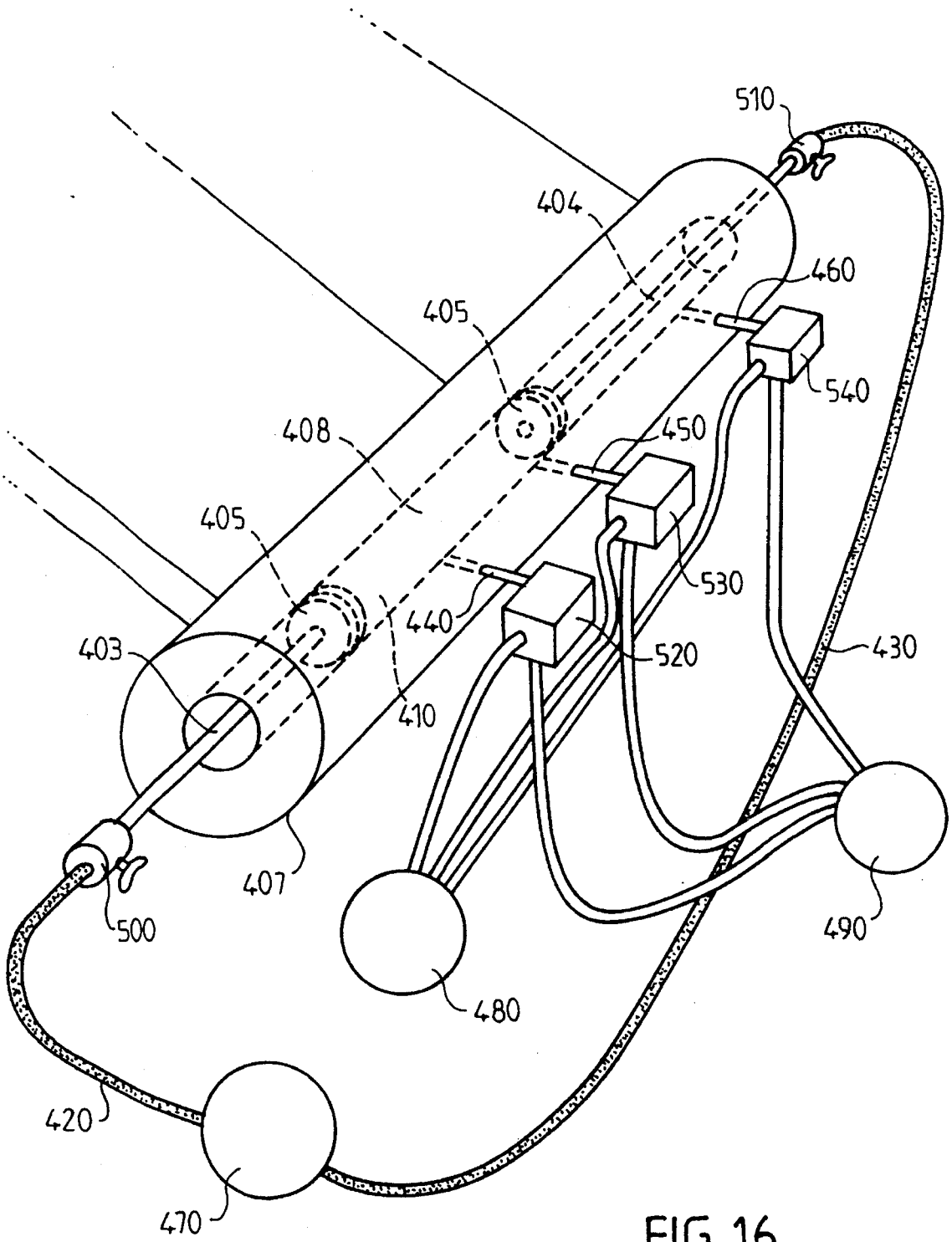
FIG. 16 is a schematic perspective view showing a coating and/or impregnating device comprising a feed chamber, inside which two feed delimiters are mounted to as to be movable in translation.
Figure 17:
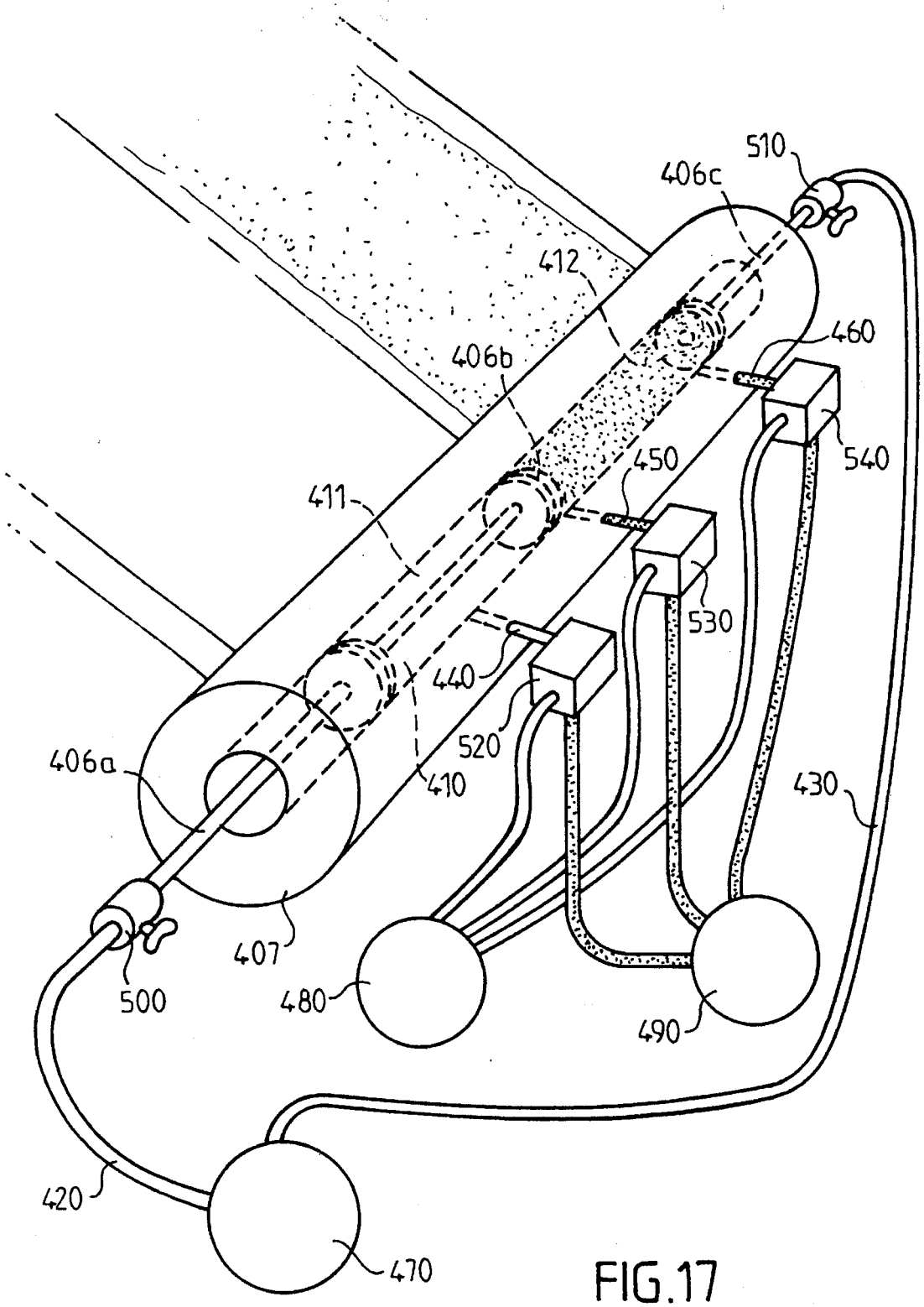
FIG. 17 is a view similar to that of FIG. 16, showing a feed chamber, inside which three feed delimiters are mounted to as to be movable in translation.

Referring to FIG. 15, it can be seen that the band 2 is deflected via a deflecting roller 400 which guides it, in particular so that it passes around cylinder 407. In this form of embodiment, this deflecting roller 400 has, on a portion of its shell 401, a set of orifices 409, disposed in staggered fashion, opening externally and communicating internally with a product feed chamber 410, In addition, this feed chamber 410 is equipped with two elements, 403–404, one of the ends of which comprises a plug 405 delimiting a feed core 408 thereof, which each constitute a feed delimiter mounted for transverse movement inside chamber 410, according to a range of travel that can be adjusted and regulated, as illustrated in FIG. 16, or with three elements 406*a*, 406*b*, 406*c*, one of the ends of which also comprises a plug, and which each constitute a feed delimiter by delimiting two feed cores 411, 412, the range of travel of which can be adjusted and regulated according to requirements, as more particularly apparent; from FIG. 17.

Thus, as a function of the type of band to be coated, it is possible to adjust the width of the band coated and/or impregnated and, in the case of three feed delimiters 406*a*–406*c*, different products can be applied, which increases the utilisation capabilities of the device according to the invention.

When the band to be coated is not being processed, deflecting roller 400 is in a rest position, illustrated by the dotted line in FIG. 15, so that the coating device is off the band.

When it is wished to coat a portion of this band, if suffices to place the deflecting roller 400 in an active position illustrated in solid lines in FIG. 15, so that this band can pass around cylinder 407. This results in coating of the band, which takes place practically instantaneously without the said band ceasing its movement, which makes it possible, among other things, to avoid manufacturing products that travel past uncoated and which constitute waste.

Under these conditions, the coating product is supplied as and when required to the moving band so that, to halt coating instantaneously, on all or part of the width of the said band, it suffices to turn off the feed pumps and it is thus possible to check very accurately the end of operation. Furthermore, halting operations does not lead to any product overflow or any moistening of the paper liable to weaken the band, thus enabling a product, and particularly corrugated cardboard, of high quality to be manufactured.

In addition, thanks to this device, the product is only in contact with the said band at time it is finally applied. There can thus be no prolonged interference of the product with the substrate, which makes it possible, particularly when the substrate tends to absorb one of the components of the coating product more easily, to avoid an unbalance in formulation since the coating product is constantly renewed, which was not the case with conventional devices of the "scraper" type commonly used by the man of the art, wherein the reservoir of coating product is constantly in contact with the substrate.

It should also be noted that it is easy to make adjustments to the band coating width, which makes it possible, given the high production rate, to limit waste to a few meters only of cardboard that has not be correctly coated.

Furthermore, the quantity of product deposited is also regulated using a "Meyer" bar or "Champion" bar system which rotates in a direction opposite to that of the paper. Thus, according to the type of bar used, a greater or lesser amount of paper is scraped and, as a result, good control is obtained over the layer of coating deposited on the moving band.

The device according to the invention can also be equipped with a flexible scraper made of metal of a synthetic material so as to ensure better distribution of the layer of product deposited on the moving band. The excess product is then recovered via an underlying groove 418 provided in cylinder 407 and which opens out in a conduit communicating with a receptacle for recovering this product, thus limiting the risks of pollution.

Means of manual adjustment, for example via a handwheel, or means controlled by data processing means, such as an automatic unit equipped with a display, are provided to ensure displacement of the elements forming the feed delimiters 403, 404, 406*a*, 406*c* inside feed chamber 410 so as to coat the moving band over a desired width.

These means are, moreover, swiftly adjusted to avoid producing yards of cardboard that have not been coated correctly, thus making it possible to avoid waste and also to cut the cost of manufacturing this cardboard.

As to feeding the coating and/or impregnating product, feed chamber 410 of cylinder 407 is connected to feed circuits 420, 430, 440, 450 and 460 associated with pumps 470, 480 and 490.

More precisely, circuits 420 and 430 are connected to a feed pump 470 and they each have at their input an on-off valve 500, 510 of a well-known conventional type, which enables them to be opened or closed as required.

Moreover, circuits 440, 450 and 460 are connected, on one hand to a drainage pump 480 and, on the other hand, to a feed pump 490, and they are also equipped at their inputs with a multi-way valve 520, 530 and 543, which permits adjustable regulation of the circulation of the coating and/or impregnating products, particularly in combination with circuits 420 and 430. Indeed, it is perfectly possible to contemplate supplying with products one of circuits 420 or 430 while, at the same time, providing for feeding through one of the circuits 440, 450, 460 on standby.

By way of example, when a given area of the moving band to be coated is reached, product feed to feed chamber 410 via circuits 420, 430 is halted by turning off feed pump 470. Coating of this product then halts immediately as it no longer reaches the feed cores in feed chamber 410. Discharge pump 480 is then turned on, after valves 520, 530 and 540 have been opened, to remove the product still present inside the feed core in feed chamber 410; then, feed pump 490 is turned on after opening the circuits corresponding to valves 520, 530, 540 so as to fill the interior of chamber 410 with the desired new product with which it is wished to coat the moving band.

Control of the different valves is dependent upon the positions of the feed delimiters 403–404, 406–406*c* inside chamber 410, and it can be contemplated, in particular, regulating and adjusting the positions of the plugs via data processing means, such as a programmable automatic unit, during the discharge operation effected by discharge pump 480, since the volume contained in the cores represents only a few liters, and this operation necessitates a relatively short discharge time.

In certain cases, in order to obtain a uniform moisture content for the band so as to ensure the flatness of the material, it can be contemplated moistening the moving band with a film of water and, in particular, the portion of the band that it is not wished to coat. For this purpose, as more especially illustrated in FIG. 17, feed chamber 410 is equipped with three delimiters 406*a*–406*c*, and the core is fed with products through circuit 420, valve 500 of which is open, via pump 470, circuit 430, for its part, not being supplied with working products as its valve 520 is closed.

The water for moistening is fed into the core via pump 490 by means of circuits 450 and 460, the valves 530 and 540 of which are open. In this case, only valve 520 in feed circuit 440 is in closed position, so that it does not allow a product to be introduced into this part of the core. Of course, the core could also be fed with working products via circuit 440, the valve 520 of which would be open, with the water arriving, in this case, via circuit 430, valve 510 of which is open inside the core, the other valves 500, 530 and 540 remaining closed.

In the event of a change of product, pump 480 discharges core 412 via line 430, valve 520 of which is open, while valves 530 and 540 of circuits 450 and 460 are closed so as to keep the water contained inside cope 412.

When core 412 is discharged, pump 490 is again ready to feed this core with a desired product.

In certain applications, it is necessary to deposit strips of products or several strips of products separately; thus applies particularly to the protection of fragile labels for spirits, wherein the abrasive original cardboard compartments have to be coated with anti-abrasion products.

Now, in such applications, for reasons of economy, the coating product is placed only over a part of the height corresponding to the location of the label. In this case, as illustrated, in particular, in FIG. 18, use is made of adjustable plugs inserted inside the chamber so as to enable coated strips of approximately 150 mm each to be placed on the band of cardboard.

In this case, feed chamber 410 has transversely adjustable closing devices formed, for example, by tubes adapted to control the transverse permeability of orifices 409 and, in consequence, the width of the layer deposited, and which are surrounded by tubes 620, 630, 640, 650 pierced by mutually parallel orifices and spaced according to a given pitch, being capable of rotational movement in relation to the transverse closing devices.

Figure 18:
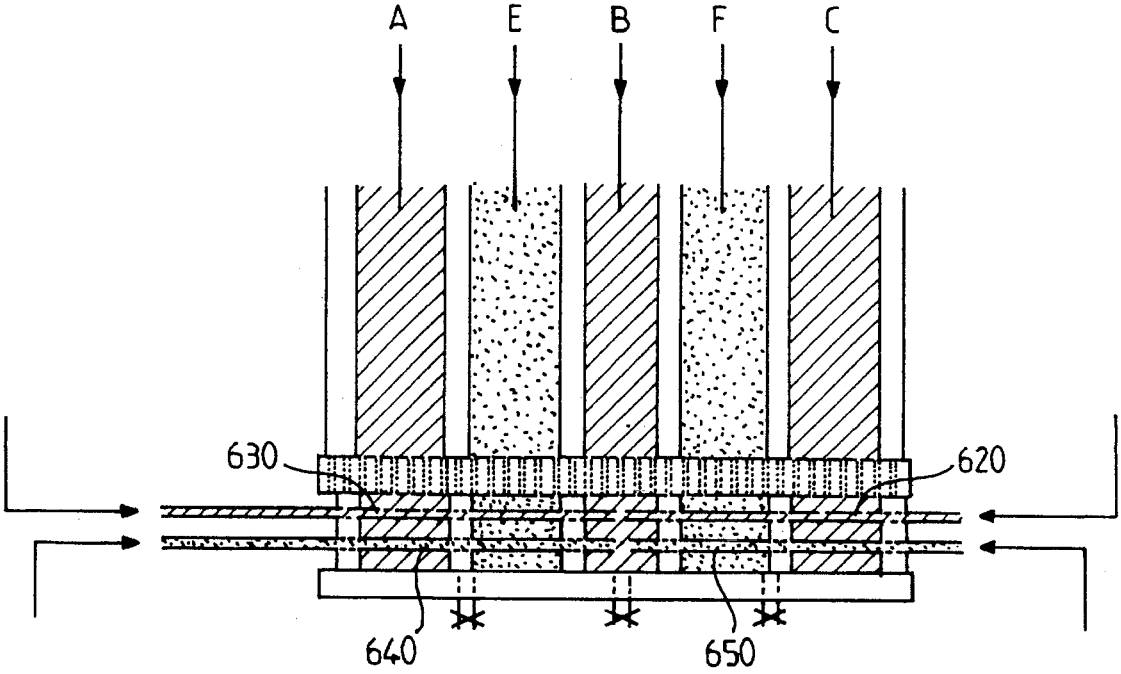
FIG. 18 is a longitudinal cross-sectional view illustrating application means represented in FIG. 17.

Thus, in the form of embodiment illustrated in FIG. 18, tubes 620 and 630 are disposed in such a way as to enable a product, for example an anti-abrasive product, to be placed on the continuously moving band of material, in the areas marked A, B and C in this figure, over an appropriate width and tubes 640 and 650 enable a layer of water to be placed over areas E and F, so as to ensure a uniform moisture content for the band and to avoid, in particular, its deformation.

Of course, it is also possible to contemplate placing, in areas E and F, coating products that are different from those deposited in areas A, B and C, according to applications and requirements, which makes it possible to enhance the utilisation capabilities of the device.

Figure 19:
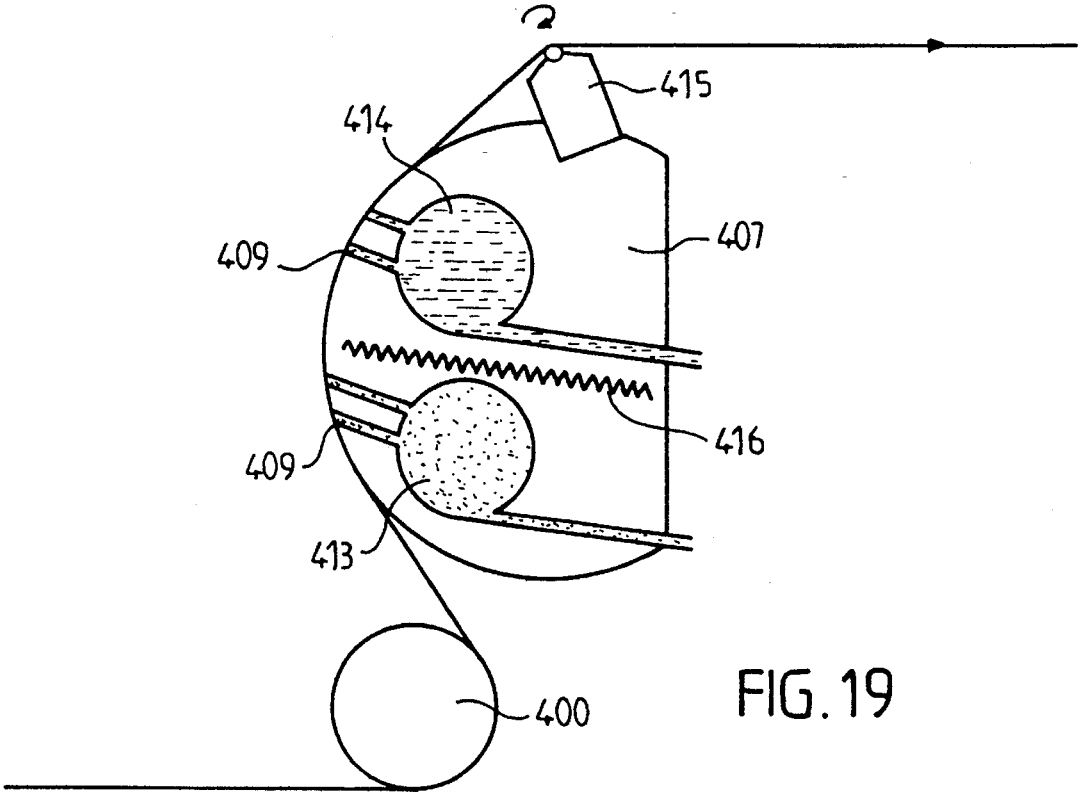
FIG. 19 is a schematic view similar to that of FIG. 15, illustrating a reservoir having two orifices for applying products of different natures.

Furthermore, as more especially illustrated in FIG. 19, it is also possible to contemplate using a cylinder 407 which comprises two feed chambers, 413–414, the interior of each of these being equipped with feed delimiters mounted so as to be capable of movement, over a stroke that is regulatable and adjustable in translation. Thus, products with which the continuously moving band is to be coated and/or impregnated can be disposed thereupon separately, which makes it possible to obtain an association of incompatible products, this being without any risk, and thus to manufacture products having qualities superior to those presently known.

Of course, means are also provided, such as, for example, a "Meyer" bar 415 so as to enable the layer to be smoothed and adjusted in quantity, thus ensuring even, regular application of the product with which the said band is to be coated.

From a practical viewpoint, this possibility of depositing several products makes the device highly advantageous since, as a function of the manufacturing programs, different types of product can thus be produced without any constraint linked with coating and/or impregnation and it is thus possible to avoid the often delicate, frequent washing of the residual chemical products present in the conduits and liable to cause pollution.

It suffices, indeed, in this case, to drain the core and to keep it filled with water, all the products remaining upstream of the valves being kept protected from the air, as well as in storage vats or in appropriate containers.

It should also be noted that the temperature of cylinder 407 can easily be raised so as to keep certain products such as paraffins melted or to heat, substantially in the region of boiling point, products that will subsequently have to be evaporated, using different types of means, such as, for example, steam-heating cylinders or through the injection of hot air or the provision of banks of infrared lamps.

Thus, by pre-heating the continously moving band of material, the subsequent application of energy is limited, thus reducing the cost of the operation.

For this purpose, it is possible to provide a set of electrical resistors 416 equipped with a thermostat placed inside cylinder 407.

In practice, it has been observed, for example, that when paper is pre-heated prior to coating, for example by heating cylinder 407 to approximately 60° C., good results are obtained, in particular for a coating product heated to 20° C.

It goes without saying that other embodiments of the present invention could have been contemplated without thereby departing from the scope thereof.

We claim:

1. A device for coating and/or impregnating a continuously moving band of material with a liquid or pasty product comprising:

an application means for depositing a layer of the product on at least partially one face of the band, said application means having a reservoir with a perforated area arranged so as to contact the face of the band as the band is deflected therearound, said perforated area having a plurality of orifices with one end opening to an exterior surface of said reservoir, said reservoir being a fixed cylinder having at least two feed delimiting means longitudinally displaceable relative to said fixed cylinder of said reservoir, said feed delimiting means for limiting at least one area of coating of the product on the band;

a product feed chamber communicating with an opposite end of said plurality of orifices interior of said application means; and scraping means for scraping the product on the band after the application means deposits the product on the band, said scraping means for scraping the product on the band so as to level the product on the band.

2. A device for coating and/or impregnating a continuously moving band of material with a liquid or pasty product comprising:

an application means for depositing a layer of the product on at least partially one face of the band, said application means having a reservoir with a perforated area arranged so as to contact the face of the band as the band is deflected therearound, said reservoir having at least one external tube having a plurality of regularly spaced radial orifices extending therethrough and opening to an exterior surface of said external tube, said reservoir having a blocking means fitted within said external tube, said blocking means for relative rotation with respect to said external tube;

a product feed chamber communicating with an opposite end of said plurality of orifices interior of said application means, said product feed chamber having a body with an inner cavity, said body having a feed delimiter affixed thereto, said feed delimiter being longitudinally displaceable along said body; and scraping means for scraping the product on the band after the application means deposits the product on the band, said scraping means for scraping the product on the band so as to level the product on the band.

3. A device for coating and/or impregnating a continuously moving band of material with a liquid or pasty product comprising:

an application means for depositing a layer of the product on at least partially one face of the band, said application means having a reservoir with a perforated area arranged so as to contact the face of the band as the band is deflected therearound, said perforated area having a plurality of orifices with one end opening to an exterior surface of said reservoir, said reservoir being a fixed cylinder having a radial blocking tube in an interior of said fixed cylinder, said radial blocking tube adapted to control a radial permeability of said plurality of orifices;

a product feed chamber communicating with an opposite end of said plurality of orifices interior of said application means; and scraping means for scraping the product on the band after the application means deposits the product on the band, said scraping means for scraping the product on the band so as to level the product on the band.

4. The device according to claim 3, said reservoir having at least one transverse blocking tube in an interior of said reservoir, said transverse blocking tube adapted to control a transverse permeability of said plurality of orifices.

5. A device for coating and/or impregnating a continuously moving band of material with a liquid or pasty product comprising:

an application means for depositing a layer of the product on at least partially one face of the band, said application means having a reservoir with a perforated area arranged so as to contact the face of the band as the band is deflected therearound, said perforated area having a plurality of orifices with one end opening to an exterior surface of said reservoir, said reservoir having at least one set of three coaxial tubes, a first tube of said coaxial tubes having a plurality of radial regularly spaced orifices extending therethrough, a second tube of said coaxial tubes having a plurality of mutually parallel annular passages extending therethrough, said annular passages spaced at a pitch corresponding to the orifices of said first tube, said second tube fitting into said first tube and adapted to be displaced in rotatable relationship to said first tube, a third tube of said coaxial tubes defining an inner conduit forming a product feed chamber, said third tube fitted within said second tube and adapted to be displaced in longitudinal translation relative to said second tube;

said product feed chamber communicating with an opposite end of said plurality of orifices interior of said application means; and scraping means for scraping the product on the band after the application means deposits the product on the band, said scraping means for scraping the product on the band so as to level the product on the band.

6. A device for coating and/or impregnating a continuously moving band of material with a liquid or pasty product comprising:

an application means for depositing a layer of the product on at least partially one face of the band, said application means having a reservoir with a perforated area arranged so as to contact the face of the band as the band is deflected therearound, said perforated area having a plurality of orifices with one end opening to an exterior surface of said reservoir, said reservoir having a transverse blocking element positioned therein, said blocking element cooperating with a plurality of tubes, said tubes having mutually parallel orifices spaced apart at a desired pitch, said transverse blocking element adapted to control a transverse permeability of said plurality of orifices at said reservoir;

a product feed chamber communicating with an opposite end of said plurality of orifices interior of said application means; and scraping means for scraping the product on the band after the application means deposits the product on the band, said scraping means for scraping the product on the band so as to level the product on the band.

* * * * *